US010184373B2

(12) United States Patent
Manickam et al.

(10) Patent No.: US 10,184,373 B2
(45) Date of Patent: Jan. 22, 2019

(54) INTERNAL COMBUSTION ENGINE FOR REDUCING EXHAUST GAS EMISSIONS

(71) Applicant: GE Jenbacher GmbH & Co. OG, Jenbach, Tiro (AT)

(72) Inventors: Bhuvaneswaran Manickam, Tirol (AT); Friedhelm Hillen, Tirol (AT); Manfred Sieberer, Tirol (AT)

(73) Assignee: GE JENBACHER GMBH & CO. OG, Jenbach (AT)

( * ) Notice: Subject to any disclaimer, the term of this patent is extended or adjusted under 35 U.S.C. 154(b) by 9 days.

(21) Appl. No.: 15/410,801

(22) Filed: Jan. 20, 2017

(65) Prior Publication Data

US 2017/0211446 A1 Jul. 27, 2017

(30) Foreign Application Priority Data

Jan. 21, 2016 (AT) ..... A 21/2016

(51) Int. Cl.

| | |
|---|---|
| ***F01N 3/10*** | (2006.01) |
| ***F01N 3/00*** | (2006.01) |
| ***F01N 3/20*** | (2006.01) |
| ***F01N 13/00*** | (2010.01) |
| ***F01N 3/28*** | (2006.01) |

(52) U.S. Cl.

CPC ..... *F01N 3/2033* (2013.01); *F01N 3/103* (2013.01); *F01N 3/2892* (2013.01); (Continued)

(58) Field of Classification Search

CPC ..... F01N 3/103; F01N 3/2033; F01N 3/2892; F01N 2240/12; F01N 2340/02; (Continued)

(56) References Cited

U.S. PATENT DOCUMENTS 3,808,806 A 5/1974 Nakamura et al.
3,968,645 A 7/1976 Noguchi et al.
(Continued)

FOREIGN PATENT DOCUMENTS

DE 2 259 946 A1 6/1974
GB 1 383 881 A 2/1974
(Continued)

OTHER PUBLICATIONS

Office Action issued in connection with corresponding at Application No. A 21/2016 dated Dec. 5, 2016.

*Primary Examiner* — Phutthiwat Wongwian
*Assistant Examiner* — Diem Tran
(74) *Attorney, Agent, or Firm* — GE Global Patent Operation; Rita D. Vacca

(57) ABSTRACT

An internal combustion engine is provided, which includes at least one combustion chamber, and a turbocharger with an exhaust gas turbine and an exhaust gas after-treatment device. The exhaust gas after-treatment device has a first catalytic converter arranged aerodynamically between the at least one combustion chamber and the exhaust gas turbine. A second catalytic converter is arranged aerodynamically between the first catalytic converter and the exhaust gas turbine, and at least one partial oxidation chamber is arranged aerodynamically between the first catalytic converter and the second catalytic converter. Also provided is a method for reducing exhaust gas emissions of an internal combustion engine.

18 Claims, 4 Drawing Sheets

(52) U.S. Cl.
CPC ..... *F01N 13/009* (2014.06); *F01N 13/0093* (2014.06); *F01N 13/0097* (2014.06); *F01N 2240/12* (2013.01); *F01N 2340/02* (2013.01); *F01N 2340/06* (2013.01)

(58) Field of Classification Search
CPC ..... F01N 2340/06; F01N 13/009; F01N 13/0093; F01N 13/0097
USPC ..... 60/280, 286, 287, 297, 311
See application file for complete search history.

(56) References Cited

U.S. PATENT DOCUMENTS 6,651,432 B1 * 11/2003 Gray, Jr. ..... F01N 3/035 123/305
6,865,882 B2 * 3/2005 Minami ..... F01N 3/023 60/288
7,267,805 B2 * 9/2007 Bruck ..... F01N 3/01 422/177
7,500,999 B2 * 3/2009 Aaron ..... B01J 8/0496 422/211
7,856,807 B2 * 12/2010 Gibson ..... B01F 5/0603 60/274
8,544,266 B2 * 10/2013 Bruck ..... F01N 3/023 60/602
2012/0216529 A1 * 8/2012 Joshi ..... F01N 3/0842 60/602

FOREIGN PATENT DOCUMENTS

WO 97/40266 A2 10/1997
WO 2014/020230 A1 2/2014

* cited by examiner

INTERNAL COMBUSTION ENGINE FOR REDUCING EXHAUST GAS EMISSIONS

BACKGROUND

Embodiments of the present invention relate to an internal combustion engine for reducing exhaust gas emissions.

A generic internal combustion engine is described in WO 2014/020230 A1, which is incorporated herein by reference in its entirety. If the total hydrocarbons (THC) present in the exhaust gas are to be oxidized to $CO_2$ and $H_2O$, this requires temperatures over 500° C., large catalytic converter volumes and oxidation catalytic converters with a high platinum group metal (PGM) loading, which makes such exhaust gas after-treatment devices very expensive.

BRIEF DESCRIPTION

The object of the embodiments of the invention is to provide a generic internal combustion engine with an exhaust gas after-treatment device in which the same catalytic effect as is known in the field can be achieved with a smaller catalytic converter volume.

This object is achieved by an internal combustion engine with the features described herein.

In an embodiment, the internal combustion engine includes first and second catalytic converters, which are both oxidation catalytic converters.

In an embodiment of the invention, the at least one partial oxidation chamber has at least two piping sections, whereby one of the at least two piping sections is arranged at least partially within another of the two piping sections at the least that are connected in series aerodynamically.

In an embodiment of the invention, the at least one partial oxidation chamber has at least one helical curved tube. In another embodiment, the at least one partial oxidation chamber has multiple helical curved tubes.

In an embodiment of the invention, the volume of the first catalytic converter is selected in such a way that, in the normal operation of the internal combustion engine, the exhaust gas temperature after passing through the first catalytic converter is at least 560° C., however it may be beneficial if the temperature is at least 590° C. If the exhaust gas exposure time in the partial oxidation chamber is increased, lower temperatures can also suffice. This is also possible if easily oxidizable additives are added to the exhaust gas prior to it entering the partial oxidation chamber.

In an embodiment of the invention, a bypass can be provided, which can be adjusted by means of a bypass valve, through which the exhaust gas can flow around the exhaust gas after-treatment device to the exhaust gas turbine.

In front of the first catalytic converter, a valve may be provided which allows the flow path to be blocked off via the first catalytic converter, the partial oxidation chamber and the second catalytic converter.

Embodiments of the invention can be used in a stationary internal combustion engine, for marine applications or mobile applications such as the so-called "non-road mobile machinery" (NRMM), or more particularly as a reciprocating piston engine. The internal combustion engine can be used as a mechanical drive, e.g. for operating compressor systems or coupled with a generator to a genset for generating electrical energy. In an embodiment, the internal combustion engine may have a number of combustion chambers.

In an embodiment of the invention, a method for reducing exhaust gas emissions of an internal combustion engine is provided. The method includes providing an internal combustion engine having at least one combustion chamber, a turbocharger with an exhaust gas turbine and an exhaust gas after-treatment device, a first and a second catalytic converter, and at least one partial oxidation chamber; in the at least one combustion chamber, producing exhaust gas by the partial combustion of a fuel-air mixture; feeding the exhaust gas to the exhaust gas after-treatment device; oxidizing at least a portion of hydrocarbons in the exhaust gas in the first catalytic converter, which is arranged between the at least one combustion chamber and the exhaust gas turbine, thereby increasing the temperature of the exhaust gas as it exits the first catalytic converter; and in the at least one partial oxidation chamber, partially oxidizing the exhaust gas. The exhaust gas is then oxidized in the second catalytic converter, which is arranged between the first catalytic converter and the exhaust gas turbine.

BRIEF DESCRIPTION OF THE DRAWINGS

Exemplary embodiments of the invention are discussed with reference to the figures, as follows.

DETAILED DESCRIPTION

Figure 1:
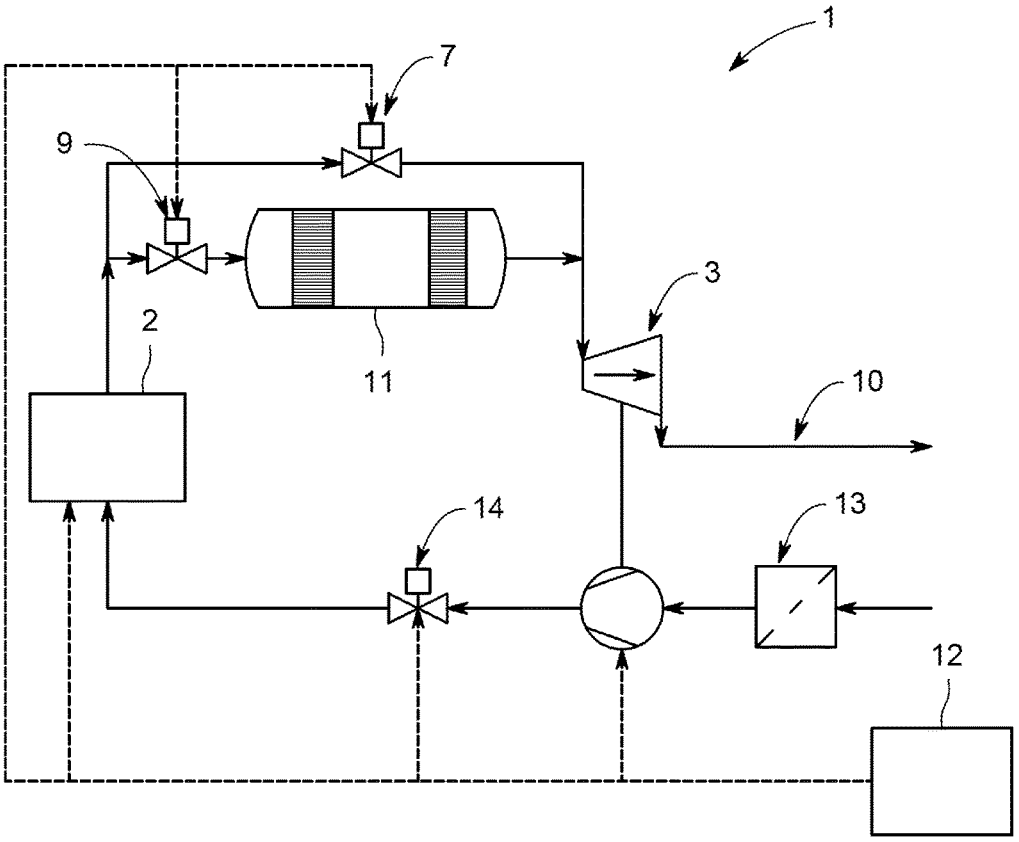
FIG. 1 shows a schematic representation of an internal combustion engine according to an embodiment of the invention.

Reference will now be made in detail to present embodiments of the disclosure, one or more examples of which are illustrated in the accompanying drawings. The detailed description uses numerical designations to refer to features in the drawings. Like or similar designations in the drawings and description have been used to refer to like or similar parts of the disclosure.

Embodiments of the invention combine a gas-phase oxidation and catalytic oxidation processes, whereby the exhaust gas emissions of the internal combustion engine can be reduced with a smaller total catalytic converter volume of the first and second catalytic converters compared to the prior art. The heat energy generated by the oxidation of the pollutants contained in the exhaust gas (primarily hydrocarbons, CO, $CH_2O$) increases the thermal efficiency of the internal combustion engine.

Embodiments of invention are based on a multistage exhaust gas after-treatment, whereby a portion of the hydrocarbons contained in the exhaust gas is oxidized in the first catalytic converter, which increases the temperature of the exhaust gas exiting the first catalytic converter. As a result, the partial oxidation that occurs in the partial oxidation chamber, in particular that of $CH_4$, is increased. The partial oxidation, which itself emits heat energy, is also increased by a longer residence time in the partial oxidation chamber. The products resulting from the partial oxidation, in particular CO, the hydrocarbons still present in the exhaust gas, and other pollutants still present, e.g. $CH_2O$, are oxidized in the second catalytic converter.

An internal combustion engine 1 according to an embodiment of the invention is shown in FIG. 1. It has a number of combustion chambers 2, to which a fuel-air mixture is fed via an intake duct. Air filter 13 and a compressor of a turbocharger are arranged in the intake duct. The quantity of fuel-air mixture supplied to combustion chambers 2 can be adjusted by means of valve 14, which can be actuated by regulating device 12 of internal combustion engine 1. Exhaust gas, which is produced by the partial combustion of the fuel-air mixture in combustion chambers 2, is fed to exhaust gas after-treatment device 11, before flowing through exhaust gas turbine 3 of the turbocharger and entering exhaust gas discharge line 10.

A bypass is provided, by means of which untreated exhaust gas can be fed directly to exhaust gas turbine 3 around exhaust gas after-treatment device 11 when valve 7 is actuated by regulating device 12.

Figure 2:
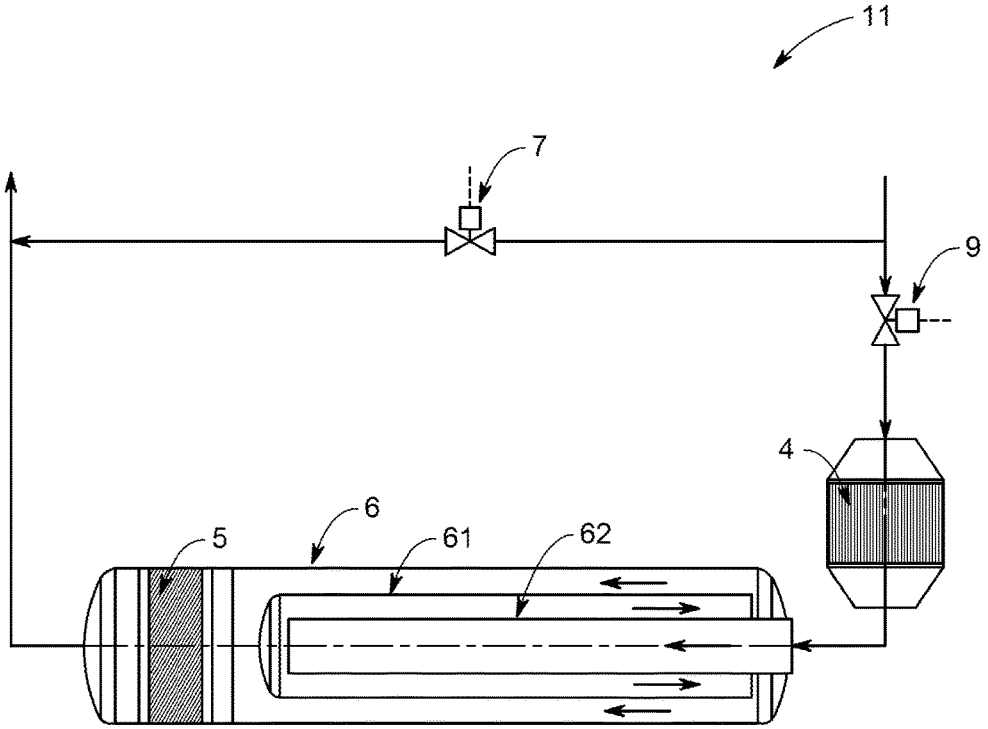
FIG. 2 shows a possible design of the partial oxidation chamber according to an embodiment of the invention.

FIG. 2 shows an exhaust gas after-treatment device 11 according to an embodiment of the invention. In front of the first catalytic converter, valve 9 may be provided which allows the flow path to be blocked off via first catalytic converter 4, partial oxidation chamber 6 and second catalytic converter 5.

A possible design of exhaust gas after-treatment device 11 is shown in FIG. 2. In this exemplary embodiment, partial oxidation chamber 6 is designed as one structural unit together with second catalytic converter 5, although this is not absolutely necessary.

Here, partial oxidation chamber 6 has two piping sections 61, 62, whereby one of the two piping sections 61, 62 is arranged at least partially in the other of the two piping sections 61, 62, and the at least two piping sections are connected in series aerodynamically, as shown by the flow arrows. This results in a compact design of partial oxidation chamber 6 with a long exposure time of exhaust gas.

Figure 3:
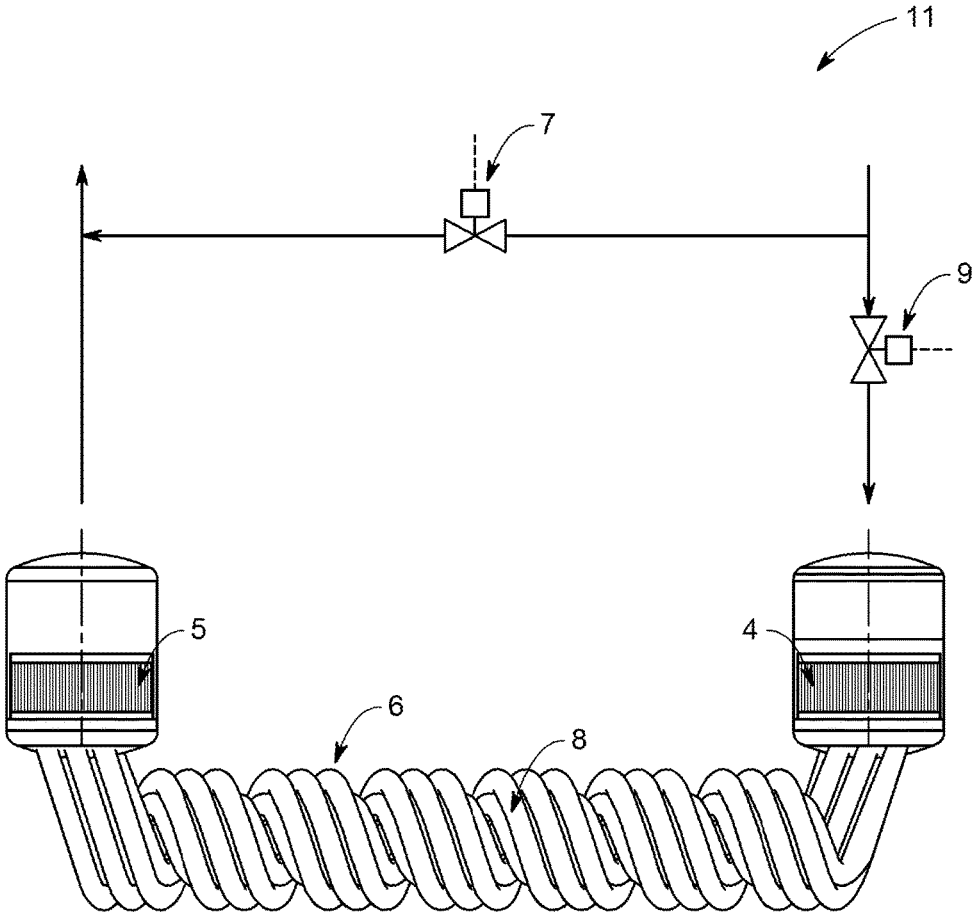
FIG. 3 shows a further possible design of the partial oxidation chamber according to an embodiment of the invention.

In the exemplary embodiment of FIG. 3, partial oxidation chamber 6 has a number of helical curved tubes 8, which also results in a compact design of partial oxidation chamber 6 with a long exposure time of exhaust gas.

Figure 4:
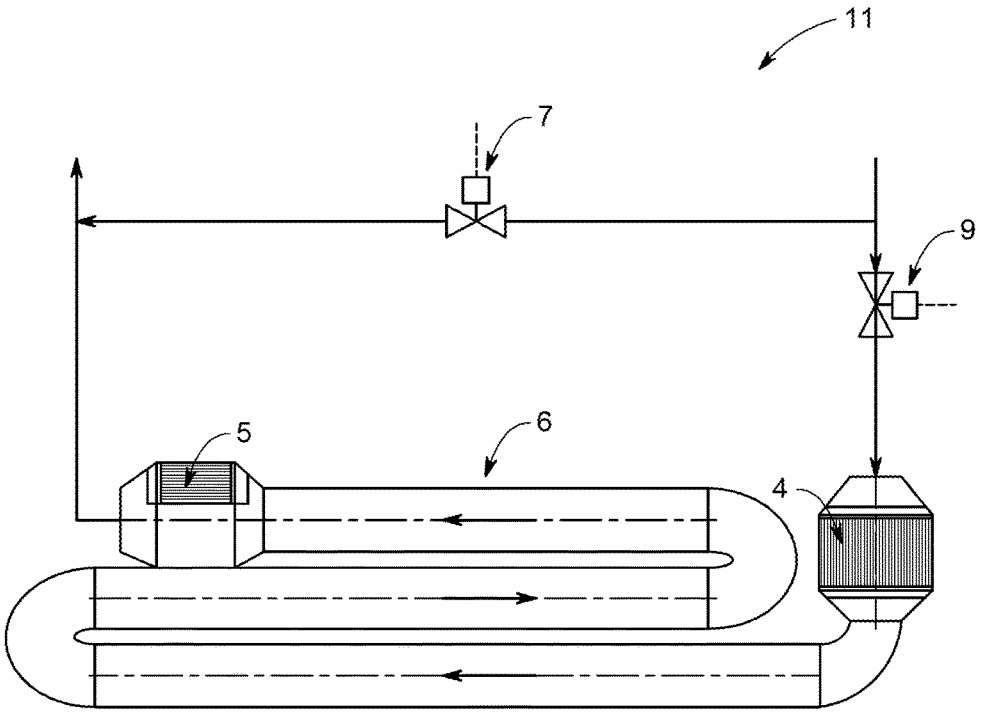
FIG. 4 shows a further possible design of the partial oxidation chamber according to an embodiment of the invention.

FIG. 4 shows a further possible design, in which an extension of partial oxidation chamber 6 was achieved by means of a loop shape.

In an embodiment of the invention, the internal combustion engine as shown in FIG. 1 can be used for reducing exhaust gas emissions of an internal combustion engine 1. The method according to an embodiment of the invention includes providing an internal combustion engine 1 having at least one combustion chamber 2, a turbocharger with an exhaust gas turbine 3 and an exhaust gas after-treatment device 11, as shown in FIGS. 1-4, a first and a second catalytic converter 4, 5, and at least one partial oxidation chamber 6; in the at least one combustion chamber 2, producing exhaust gas by the partial combustion of a fuel-air mixture; feeding the exhaust gas to the exhaust gas after-treatment device 11; oxidizing at least a portion of hydrocarbons in the exhaust gas in the first catalytic converter 4, which is arranged between the at least one combustion chamber 2 and the exhaust gas turbine, thereby increasing the temperature of the exhaust gas as it exits the first catalytic converter 4; and in the at least one partial oxidation chamber 6, partially oxidizing the exhaust gas. The exhaust gas is then oxidized in the second catalytic converter 5, which is arranged between the first catalytic converter 4 and the exhaust gas turbine.

It is to be understood that even though numerous characteristics and advantages of various embodiments have been set forth in the foregoing description, together with details of the structure and functions of various embodiments, this disclosure is illustrative only, and changes may be made in detail, especially in matters of structure and arrangement of parts within the principles of the embodiments to the full extent indicated by the broad general meaning of the terms in which the appended claims are expressed. It will be appreciated by those skilled in the art that the teachings disclosed herein can be applied to other systems without departing from the scope and spirit of the application.

What is claimed is:

1. An internal combustion engine comprising:

at least one combustion chamber;

a turbocharger with an exhaust gas turbine;

an exhaust gas after-treatment device, the exhaust gas after-treatment device comprising a first catalytic converter arranged aerodynamically between the at least one combustion chamber and the exhaust gas turbine;

a second catalytic converter arranged aerodynamically between the first catalytic converter and the exhaust gas turbine; and at least one partial oxidation chamber arranged aerodynamically between the first catalytic converter and the second catalytic converter, the at least one partial oxidation chamber comprises multiple helical curved tubes with at least one helical curved tube arranged around another helical curved tube.

2. The internal combustion engine according to claim 1, wherein the at least one partial oxidation chamber has of the multiple helical curved tubes, at least two helical curved tubes are of differing helices.

3. The internal combustion engine according to claim 2, wherein the multiple helical curved tubes are connected aerodynamically in parallel.

4. The internal combustion engine according to claim 1, wherein the internal combustion engine is coupled with a generator to a genset.

5. The internal combustion engine according to claim 1, wherein a volume of the first catalytic converter is selected such that, under normal operation of the internal combustion engine, an exhaust gas temperature after passing through the first catalytic converter is at least 560° C.

6. The internal combustion engine according to claim 1, wherein a volume of the first catalytic converter is selected such that, under normal operation of the internal combustion engine, an exhaust gas temperature after passing through the first catalytic converter is at least 590° C.

7. The internal combustion engine according to claim 1, wherein oxidation additives are added to the exhaust gas before the exhaust gas enters the at least one partial oxidation chamber.

8. The internal combustion engine according to claim 1, further comprising a bypass with a bypass valve through which exhaust gas flows, wherein the bypass valve is adjustable for exhaust gas flow around the exhaust gas after-treatment device to the exhaust gas turbine.

9. The internal combustion engine according to claim 1, further comprising a valve arranged in front of the at least one combustion chamber, wherein the valve is configured to adjust a quantity of a fuel-air mixture supplied to the at least one combustion chamber.

10. The internal combustion engine according to claim 1, wherein the at least one partial oxidation chamber and the second catalytic converter are contained together in one structural unit.

11. The internal combustion engine according to claim 1, wherein the internal combustion engine comprises multiple combustion chambers.

12. A method for reducing exhaust gas emissions of an internal combustion engine, comprising:

providing an internal combustion engine comprising at least one combustion chamber, a turbocharger with an exhaust gas turbine, an exhaust gas after-treatment device, a first catalytic converter, a second catalytic converter, and at least one partial oxidation chamber;

producing in the at least one combustion chamber, an exhaust gas by a partial combustion of a fuel-air mixture;

feeding the exhaust gas to the exhaust gas after-treatment device;

oxidizing at least a portion of hydrocarbons in the exhaust gas in the first catalytic converter, arranged between the at least one combustion chamber and the exhaust gas turbine, thereby increasing a temperature of the exhaust gas exiting the first catalytic converter;

partially oxidizing the exhaust gas in the at least one partial oxidation chamber, the at least one partial oxidation chamber comprises multiple helical curved tubes with at least one helical curved tube arranged around another helical curved tube; and oxidizing the exhaust gas in the second catalytic converter arranged between the first catalytic converter and the exhaust gas turbine.

13. The method according to claim 12, wherein the multiple helical curved tubes are connected aerodynamically in parallel.

14. The method according to claim 12, further comprising providing a bypass valve, through which the exhaust gas flows around the exhaust gas after-treatment device directly to the exhaust gas turbine.

15. The method according to claim 12, further comprising providing a valve arranged in front of the at least one combustion chamber, wherein the valve is configured to adjust a quantity of a fuel-air mixture supplied to the at least one combustion chamber.

16. The method according to claim 12, wherein products formed from the partial oxidation, and hydrocarbons and pollutants present in the exhaust gas, are oxidized in the second catalytic converter.

17. The method according to claim 16, wherein the pollutants comprise $CH_2O$.

18. The method according to claim 16, wherein the products formed from the partial oxidation are CO.

* * * * *